US006675448B2

(12) United States Patent
Revel

(10) Patent No.: US 6,675,448 B2
(45) Date of Patent: Jan. 13, 2004

(54) MAGNETIC CLOSURE, PARTICULARLY FOR BAGS AND THE LIKE

(75) Inventor: Franco Revel, Gallarate (IT)

(73) Assignee: SAMA S.p.A., Ronco Briantino (IT)

( * ) Notice: Subject to any disclaimer, the term of this patent is extended or adjusted under 35 U.S.C. 154(b) by 0 days.

(21) Appl. No.: 10/336,692

(22) Filed: Jan. 6, 2003

(65) Prior Publication Data

US 2003/0131452 A1 Jul. 17, 2003

(30) Foreign Application Priority Data

Jan. 16, 2002 (IT) ..... MI2002A0075

(51) Int. Cl.[7] ..... A44B 21/00; H01F 7/00
(52) U.S. Cl. ..... 24/303; 24/66.1; 292/251.5
(58) Field of Search ..... 24/303, 66.1; 292/251.5

(56) References Cited

U.S. PATENT DOCUMENTS 3,324,521 A * 6/1967 Humiston ..... 24/303
5,042,116 A * 8/1991 Ossiani ..... 24/303
5,572,772 A * 11/1996 Morita ..... 24/303
5,664,298 A * 9/1997 Nessar-Ivanovic ..... 24/303
5,682,653 A * 11/1997 Berglof et al. ..... 24/303
5,983,464 A * 11/1999 Bauer ..... 24/303

* cited by examiner

*Primary Examiner*—Victor Sakran
(74) *Attorney, Agent, or Firm*—Guido Modiano; Albert Josif; Daniel O'Byrne

(57) ABSTRACT

A magnetic closure, comprising a male element and a female element, each of which comprises:

a keeper plate, which is suitable to support a pair of magnets and to support in a downward region means for fixing the male element or the female element;

a dome for covering the keeper plate that supports the magnets, the covering dome being provided with a slot that allows the passage of an engagement pin in the male element, the engagement pin being adapted to engage the slot of the covering dome of the female element;

its particularity consisting in that the magnets are supported by the keeper plate so that they are spaced apart.

8 Claims, 2 Drawing Sheets

MAGNETIC CLOSURE, PARTICULARLY FOR BAGS AND THE LIKE

BACKGROUND OF THE INVENTION

The present invention relates to a magnetic closure for personal articles such as wearing apparel and traveling articles, and particularly for bags and the like. More particularly, the invention relates to a magnetic closure that allows easier closure without requiring the user to push in any way the two portions of the closure in order to close it.

As is known, a magnetic closure is constituted by a male element and a female element in which the male element mates with the female element.

In particular, a closure of the type according to the invention is provided by means of a metallic plate on which the magnet is arranged; the plate is covered by a dome-shaped covering element provided with a slot from which a male engagement pin protrudes. In turn, the female element of the magnetic closure comprises a metallic plate on which the magnet is arranged; said plate is covered by a dome, similar to the dome of the male element, and is provided with a slot through which it is engaged by said male pin. Clearly, the male element and the female element of the magnetic closure must be applied to two flaps that must be coupled one another.

The solution proposed above, however, has drawbacks, due to the fact that the magnet that is arranged on the plate of the female element and the magnet that is arranged on the plate of the male element are actually constituted by a pair of rectangular magnets adapted to be arranged themselves adjacent to the slot of the dome that covers the plate to which the magnets are applied. However, due to the magnetic attraction, the magnets arranged on the plate may tend to move mutually closer, thus interfering with the engagement of the male pin in the respective slot of the dome of the female element or of the dome of the male element.

Therefore, the magnetic closure provided according to the known art has the drawback that the user may be forced, in order to perform correct closure, to push with one hand in order to force the engagement of the male pin in the respective slot.

This of course leads to a less than optimum closure, since it forces the user to perform an additional operation besides the normal operation of placing adjacent the two flaps provided with the magnetic closure.

SUMMARY OF THE INVENTION

The aim of the present invention is to provide a magnetic closure that allows to perform closure simply by placing adjacent the two male and female portions of the magnetic closure.

Within this aim, an object of the present invention is to provide a magnetic closure that allows coupling between the male element of the magnetic closure and the corresponding female element, without any interference due to magnetic attraction between the magnets of the male element of the closure and between the magnets of the female element of the magnetic closure.

Another object of the present invention is to provide a magnetic closure that is highly reliable, relatively simple to manufacture and at competitive costs.

This aim and these and other objects that will become better apparent hereinafter are achieved by a magnetic closure for personal articles, comprising an engagement pin, a male element and a female element, each one of said male and female elements comprising:

a keeper plate, which is adapted to support a pair of magnets and to support in a downward region means for fixing said male element or said female element;

a dome for covering said keeper plate that supports said magnets, said covering dome being provided with a slot that allows the passage of the engagement pin in said male element, said engagement pin being adapted to engage the slot of the covering dome of the female element; and wherein said magnets are supported by said keeper plate so that they are spaced apart.

BRIEF DESCRIPTION OF THE DRAWINGS

Further characteristics and advantages of the invention will become better apparent from the description of the magnetic closure according to the present invention, illustrated only by way of non-limitative example in the accompanying drawings, wherein.

DESCRIPTION OF THE PREFERRED EMBODIMENTS

Figure 1:
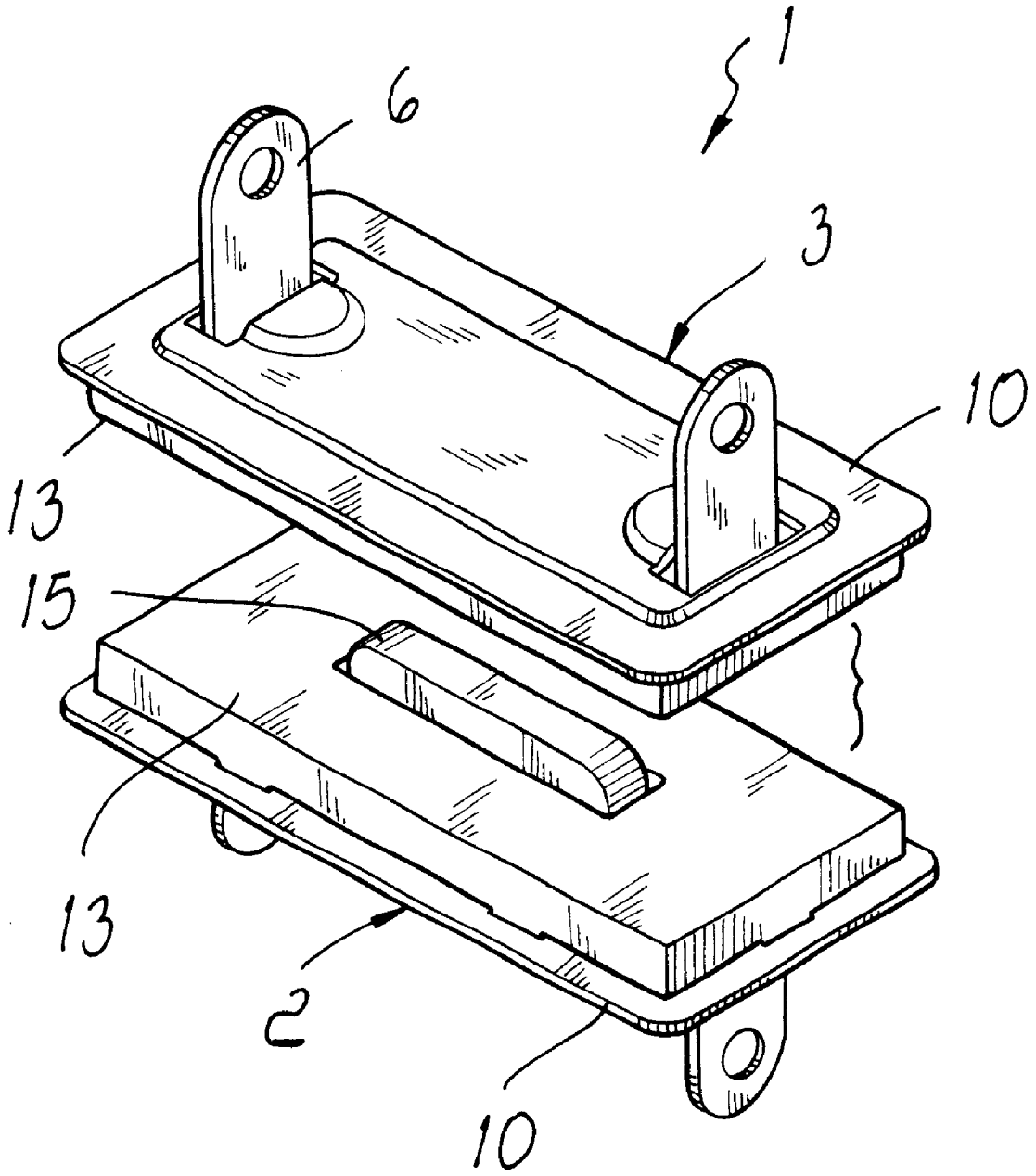
FIG. 1 is a perspective view of the magnetic closure according to the present invention.

With reference to the figures, the magnetic closure for personal articles according to the present invention, generally designated by the reference numeral 1, comprises a male element 2 that is adapted to be mated with a female element 3 of the magnetic closure.

The male element 2 and the female element 3 are substantially constituted by the same components, and therefore the description is given for the male element and applies equally to the female element, and accordingly will not be repeated.

The male element 2 is therefore constituted by a keeper plate 4 on which two magnets 5*a* and 5*b* are arranged. The keeper plate is made of metal.

Fixing means, in particular a U-shaped bracket 6 is connected in a downward region to the keeper plate 4 and is provided with two legs 7 and 8 provided with two holes 9 and 10, which allow to apply the male element to one of the flaps to be closed. Finally, there is also a rear plate 10 provided with openings 11 for the passage of the legs 7 and 8 in order to close in a downward region the structure of the male element 2.

Above the keeper plate 4, the male element 2 has a covering dome 13, which is conveniently provided with a rectangular central opening or slot 14 that allows the passage of an engagement pin 15, which is adapted to engage the corresponding opening or slot 14 provided in the covering dome 13 of the female closure element 3.

Figure 2:
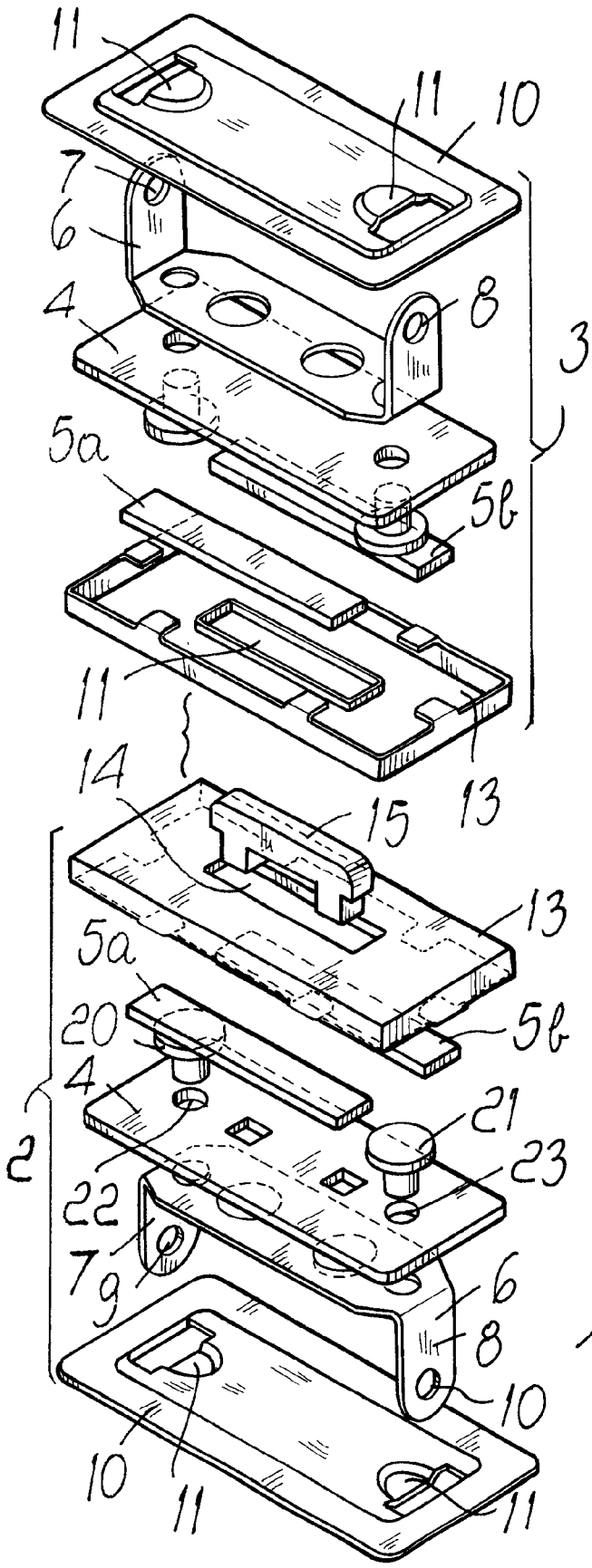
FIG. 2 is an exploded perspective view of a magnetic closure according to the present invention.

As clearly shown, FIG. 2 is substantially divided into two portions, each of which illustrates one of the two male and female elements 2 and 3. The upper portion of FIG. 2 illustrates the female element 3, while the lower portion of FIG. 2 illustrates the male element 2.

In both portions of FIG. 2, the same reference numerals are used to designate identical or corresponding elements.

The particularity of the invention resides in that the two magnets 5*a* and 5*b*, shaped in a preferred embodiment as rectangular parallelepipeds, arranged on the keeper plate 4, are separated by at least one spacer element, preferably a pair of spacer elements, conveniently constituted by a first pin 20 and a second pin 21, which are accommodated in corresponding holes 22 and 23 formed in the keeper plate 4. The two pins 20 and 21 have a head portion whose diameter is larger than the stem of the pin that engages in the holes 22 and 23.

Therefore, once the pins 20 and 21 have engaged in the respective holes 22 and 23, the magnets 5*a* and 5*b* arranged on the keeper plate 4 are adjacent to said pins and in lateral abutment contact against them.

The spacer elements, i.e., the pins 20 and 21, therefore allow the magnets 5*a* and 5*b* not to be affected i.e. moved by an attraction force, thus preventing their unwanted mutual approach, since such an approach would interfere with the engagement of the male pin 15 that protrudes from the slot 14 and is adapted to engage the respective slot 14 of the female element that lies opposite the male element.

In practice, it has been found that the magnetic closure according to the invention fully achieves the intended aim and objects, since it allows the magnets that are present on the keeper plates of the male and female elements not to interfere with the male pin 15 that protrudes from the slot 14 of the male element and engages in the corresponding slot 14 of the female element.

Therefore, the magnetic closure thus provided operates without the problems observed in the known art, since the user can simply arrange in mutually adjacent configuration the two flaps on which the elements of the magnetic closure are provided, without having to push in order to engage the male pin in the corresponding opening of the female element.

In practice, the materials used, so long as they are compatible with the specific use, as well as the contingent shapes and dimensions, may be any according to requirements and to the state of the art.

The disclosures in Italian Patent Application No. MI2002A000075 from which this Application claims priority are incorporated herein by reference.

What is claimed is:

1. A magnetic closure for personal articles, comprising an engagement pin, a male element and a female element, each one of said male and female elements comprising:

a pair of magnets;

a keeper plate for supporting said pair of magnets in a spaced apart configuration, fixing means arranged in a downward region of said keeper plate for fixing said male and female elements to an articles that requires closing;

a dome for covering said keeper plate provided with a slot;

and wherein said engagement pin is arranged in said male element so as to protrude from said slot of the covering dome and to engage the slot of the covering dome of the female element.

2. The magnetic closure of claim 1, further comprising at least one spacer provided at said keeper plate to space said pair of magnets supported by said keeper plate.

3. The magnetic closure of claim 1, further comprising two spacer elements provided at said keeper plate to space said pair of magnets.

4. The magnetic closure of claim 1, wherein said magnets are shaped as rectangular parallelepipeds.

5. The magnetic closure of claim 1, wherein said spacer element of the male and female elements comprises a pin adapted to engage a respective hole formed in said keeper plate.

6. The magnetic closure of claim 5, wherein said pin comprises a cylindrical stem and a head that has a larger diameter.

7. The magnetic closure of claim 6, wherein said pin constitutes an abutment element for said magnets supported by said keeper plate.

8. The magnetic closure of claim 7, wherein said magnets are arranged in said male and female elements so as to abut against the stem of said pin engaged in the hole of said keeper plate.

* * * * *